US005113765A

United States Patent [19]

Carey et al.

[11] Patent Number: 5,113,765

[45] Date of Patent: May 19, 1992

[54] ABSOLUTE ANTI-ROLL EMERGENCY ROAD FLARE

[76] Inventors: James Carey, 1325 Barbara Dr., Vista, Calif. 92084; John J. Addario, 1748 Costada Ct., Lemon Grove, Calif. 92045; Roberto Juarez, 13432 Aubrey St., Poway, Calif. 92064

[21] Appl. No.: 799,949

[22] Filed: Nov. 29, 1991

Related U.S. Application Data

[63] Continuation-in-part of Ser. No. 502,248, Mar. 30, 1990, abandoned.

[51] Int. Cl.[5] ..... F42B 4/26

[52] U.S. Cl. ..... 102/336; 102/343

[58] Field of Search ..... 102/335, 336, 343, 345, 102/356, 358

[56] References Cited

U.S. PATENT DOCUMENTS

| | | | |
|---|---|---|---|
| 462,596 | 11/1891 | Shephard | 102/343 |
| 809,029 | 1/1906 | Stanford et al. | 102/336 |
| 2,090,911 | 8/1937 | Frizzell et al. | 102/343 |
| 2,220,407 | 11/1940 | Joss | 102/343 |
| 2,795,386 | 6/1957 | Elsey | 102/343 |
| 2,848,946 | 8/1958 | Goebig | 102/343 |
| 3,363,560 | 1/1968 | McBride | 102/343 |
| 3,524,409 | 8/1970 | Griffith et al. | 102/358 |
| 3,528,370 | 9/1970 | Gaither et al. | 102/336 |
| 3,678,856 | 7/1972 | Barocca et al. | 102/343 |
| 4,148,258 | 4/1979 | Powers | 102/343 |

*Primary Examiner*—David H. Brown

[57] ABSTRACT

A road flare is provided which is triangular in cross-section to maximize stability of the flare as is used burning on a roadway surface or the like, and to maximize packing, storing and shipping efficiency by providing a cross-sectional shape that defines a flush-pack with other flares so that no significant interstitial space is wasted within the packing, shipping and storing container.

3 Claims, 1 Drawing Sheet

14
16
10
12

14
18
16
12
22

14
5
5
22
12

60°
14
18
20

45°
14
20
18
90°

28
22

22
30

24

32

26
10

ABSOLUTE ANTI-ROLL EMERGENCY ROAD FLARE

BACKGROUND OF THE INVENTION

The instant invention is a continuation-in-part of Application No. 502,248 filed on Mar. 30, 1990. In conversations with the Examiner, it was decided that a professionally prepared written specification and set of drawings, along with emphasis on the flush-pack aspects of the flare would be necessary in order to have the case allowed.

The invention is in the field of fusee or road flares. Red road flares, which used to be primarily used on railroads, are now universally available in auto parts shops and elsewhere and are repeatedly used by peace officers to demark the scene of an accident, particularly at night, until the scene becomes safe for traffic.

The standard fusee flare is one of the most standard commodities in America. It is always cylindrical, it is always red and it always produces a bright red glowing flame.

Despite the fact that the road flare is a comfortable symbol of technologically static, inter-generational stability in changing and anxious times, there are aspects of the flare that could be improved upon.

First, because the flare is cylindrical, it has a disturbing tendency to roll away from the scene of an accident. Unfortunately, not all accidents happen on perfectly flat, horizontal pavement or pavement that is frictional enough to inhibit rolling.

Other efforts have been set forth to create flares which would not have the rolling characteristic indicated above. For example, U.S. Pat. No. 2,090,911 issued on Aug. 24, 1937, to C. S. Frizzell discloses a flare having two wire supports that may be bent on the scene to support the flare in an angulated, upright mode so that it will not roll and it will be properly positioned, spaced above the pavement.

A similar design is shown in U.S. Pat. No. 3,524,409 issued on Aug. 18, 1970, to Paul H. Griffith. This patent also discloses a fusee flare with wires which bend down to provide a three-point base support for the flare so that it will not roll.

Lastly, U.S. Pat. No. 2,848,946 issued Aug. 26, 1958, to Reba C. Goebig, discloses a cylindrical flare have a square base for the purpose of preventing rolling of the flare. Unfortunately, the square base alone will not necessarily prevent rolling on uneven pavement as the square base may not always be in contact with the pavement. Additionally, the square base does not in any way improve the capability of packing the flares in a dense, flush pack. There would still be air spaces between the cylindrical flare bodies which would reduce the packing efficiency to a theoretical maximum of 78,5%, or $\frac{1}{4}\pi$.

There is a need for, therefore, for a flare that overcomes the above-stated drawbacks of existing art by providing a flare that will dense-pack for storage and shipment and which is almost impossible to roll even on very steep, rugged terrain.

SUMMARY OF THE INVENTION

The instant invention fulfills the above-stated need by providing a flare which is triangular in cross-section and has a triangular cap, so that it will dense-pack in a theoretically 100% efficient configuration and will be almost impossible to roll. Although flares of any triangular cross-sectional configuration could be made to dense-pack, the most logical choices are the equilateral triangle and the right triangle with 45 degree leg apices. The equilateral triangle is logical because it can be packed in any of its three possible orientations about its axis and has the most mass per surface area for a triangle. The right 45 degree triangle has the advantage that it will pack perfectly flus into a rectangular or square box.

In any triangular configuration, the two goals of anti-roll and flush-pack capabilities are achieved.

DETAILED DESCRIPTION OF THE PREFERRED EMBODIMENT

Figures 1, 2, 3, 4, 5, 6, 7, 8, 9, 10, 11:
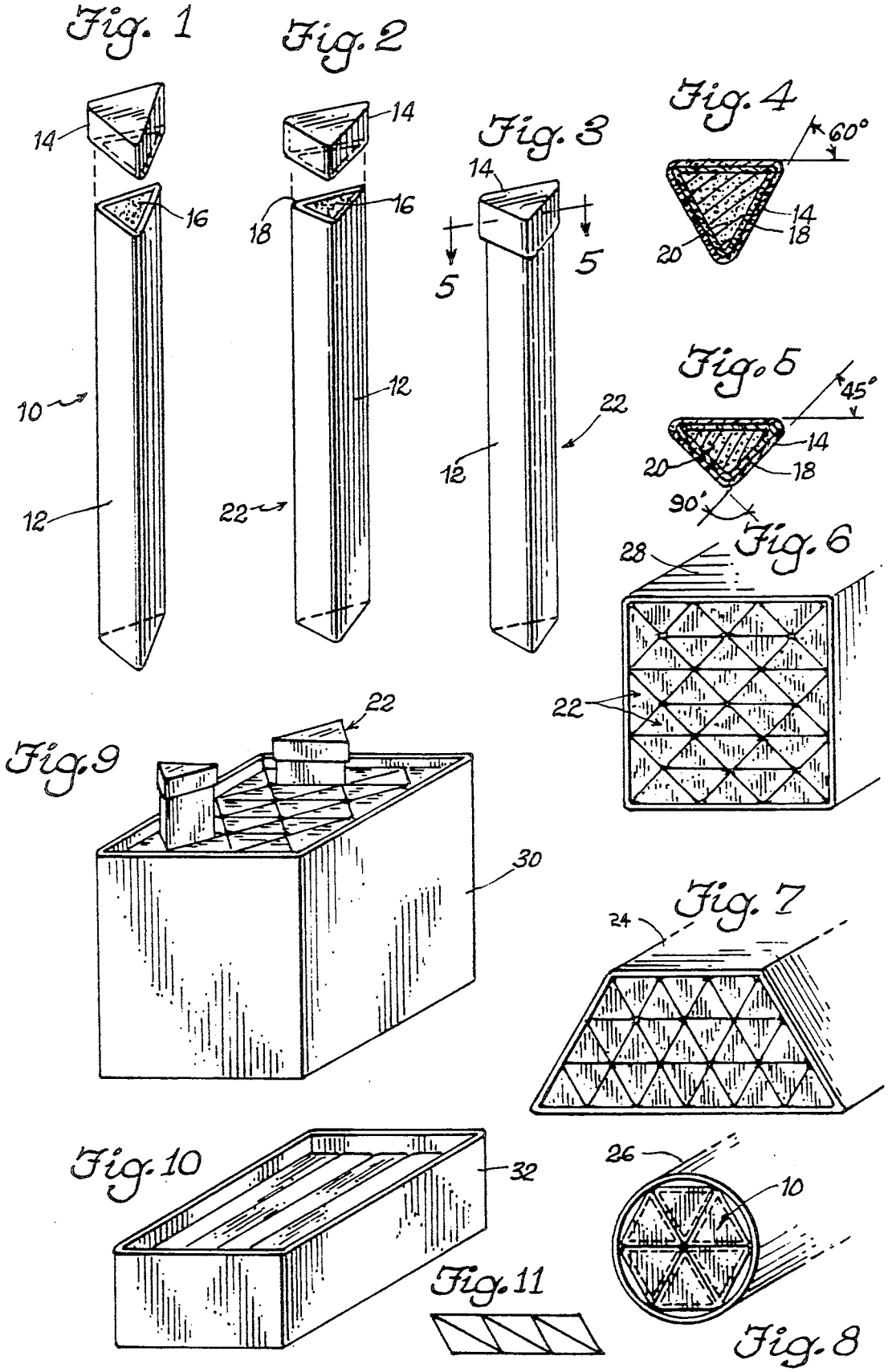
FIG. 1 is a perspective of an equilateral triangle fusee flare with the cap exploded.
FIG. 2 is identical to FIG. 1 but illustrates a right 45 degree angle triangular fusee.
FIG. 3 illustrates the flare of FIG. 2 with the cap in place.
FIG. 4 is a section taken across the capped end portion of the equilateral triangular embodiment of FIG. 1 with the cap in place.
FIG. 5 is a section taken along the line 5—5 of FIG. 3.
FIG. 6 is an end perspective of a carton in which right 45 degree triangles are the types shown in FIGS. 2, 3 and 5 are flush-packed in a square box.
FIG. 7 is a perspective end view of equilateral triangular flares flush-packed in a trapazodial container.
FIG. 8 is an end perspective view of a "six-pack" of equilateral triangular flares packed in a cylinder.
FIG. 9 is a perspective view of a vertical pack illustrating two flares pulled out as they would be for use.
FIG. 10 illustrates a more cigar-box type packing configuration for any of the triangular flares.
FIG. 11 illustrates the fact that fusees in any triangular cross-sectional shape can be made to form dense-packed parallel rows.

The equilateral cross-sectional flares illustrated at 10. It has a body portion 12 and a cap 14 of plastic or paper which protects the incendiary end 16, which is ordinarily used to strike against a surface, often a frictional surface provided on the cap, to ignite the flare. The flare body comprises an encapsulating cover or shell 18 generally made of paper, and an internal mass of packed incendiary material 20 best shown in FIGS. 4 and 5.

FIGS. 2 and 3 illustrate a flare identical to FIG. 1 except that instead of having the equilateral 60-degree apices of FIGS. 1 and 4, the flare 22 illustrated in FIGS. 2, 3 and 5 has a cross section characterized by a 90 degree angle and two 45 degree angles.

It should be very clear, especially from reviewing FIGS. 4 and 5, that it would be very difficult for these flares to roll on a flat surface, even if the surface had an angle of 15 or 20 degrees, which would be much more than any pavement surface would have. It would be virtually impossible for the flares to roll, even in most unusual circumstances. On a slick, ice-covered slope, they might slide, to which end the outer surface could be provided with some kind of anti-skid material. However, this would be an unusual circumstance and would not ordinarily justify the expense involved, unless the flares were known to be produced for use in a region known for its mountainous and icy roads.

As mentioned in the summary, the equilateral triangular cross-sectional configuration of FIGS. 1 and 4 maximizes the amount of incendiary material 20 that can be contained in a triangle with the minimum amount of surface area of the shell 18. In other words, the surface-to-mass ratio would be the highest for an equilateral triangular configuration than any other configuration.

The equilateral triangular configuration is shown packed for shipping and storage in FIGS. 7, 8 and 10. With the trapezoidal cross-sectional shape of the box 24 of FIG. 7, a complete flush-pack can be achieved. Were the box 24 rectangular or square in cross-section, the pack would still be substantially flushed but there would be some triangular spaces adjacent the edges of the rows of flares, either along the right and left sides of the box or at the top and bottom. This still would produce a pack much more dense than the current cylindrically designed flares in any kind of container.

FIG. 8 illustrates a 6-pack, which is contained in a cylindrical box 26. This might be a convenient configuration for carrying in the trunk of a private vehicle. It will also be noted that the cylindrical box of FIG. 8 indicated at 26 could also be hexagonal in cross-section, which would in turn permit the hexagonal six-packs to be dense-packed inasmuch as hexagons can be flush-packed in a honeycomb configuration.

However, the densest of all configurations is achieved by the right 45 degree angle triangular flare 22 as illustrated in FIGS. 6 and 9. As these Figures illustrate, the box container 28 can be square or rectangular in cross-section, and the flares will completely dense-pack with a theoretical zero proportion of air space between flares. As a practical matter, the corners of the flares will not be sharp-edged, as there would be no particular purpose to make them such, so there would be a minute amount of air space in the packing but nothing compared to the over 20% that currently exists in the packing of cylindrical flares.

In FIG. 9, a rectangular box 30 similar to that of FIG. 6 is illustrated, except the flares are packed vertically. Two of the flares are shown as being pulled partially out of the container. FIG. 10 illustrates a "cigar box" configuration 32 in which any kind of triangular-configuration flares can be packed as FIG. 11 illustrates a triangular configuration that is very irregular, merely to show that a packing arrangement of even, parallel-sided rows can be created from any triangular configuration whatsoever. The parallel-sided rows can then be stacked one on top of the other for a substantial flush-pack. There would be no apparent reason for producing flares in the odd configuration of FIG. 11, and this figure is merely illustrative of the base line advantage of any triangular cross-sectional flare configuration versus cylindrical flares.

It is anticipated that the equilateral triangular flare or the right 45 degree flare would be the most commercially accepted embodiments. These flares produce a regular appearance, can be dense-packed and simply will refuse to roll on any pavement surface under any conditions.

IT IS HEREBY CLAIMED:

1. A road flare comprising:

(a) an elongated body comprising a shell packed with incendiary material which illuminates when burned;

(b) said body having a substantially uniform triangular cross-section to positively prevent rolling of said flare when used on an underlying surface and to permit the substantial flush-packing of said flare in a group of flares for shipping and storage; and (c) a cap, triangular in cross-section, covering one end of said flare, which cap is removable to permit use of the flare, and is substantially flush with the body of the flare such that said cap does not interfere with flush-packing of said road flare.

2. Structure according to claim 1 wherein said body is of substantially triangular cross-sectional configuration in the shape of an equilateral triangle.

3. Structure according to claim 1 wherein said body is in the cross-sectional configuration substantially in the shape of a right 45-degree triangle.

* * * * *